US006202512B1

(12) United States Patent
O'Brien et al.

(10) Patent No.: US 6,202,512 B1
(45) Date of Patent: Mar. 20, 2001

(54) TORSION SCREWDRIVER

(76) Inventors: Daniel J. O'Brien, 2515 Camborne Pl., Cambria, CA (US) 93428; Chih-Ming Wu, No. 15-2, Kang-Hou Rd., Hsiao-Kang Dist., Kaohsiung City (TW)

( * ) Notice: Subject to any disclaimer, the term of this patent is extended or adjusted under 35 U.S.C. 154(b) by 0 days.

(21) Appl. No.: 09/248,269

(22) Filed: Feb. 11, 1999

(51) Int. Cl.[7] ..... B25B 13/00
(52) U.S. Cl. ..... 81/59.1; 81/177.4
(58) Field of Search ..... 81/58, 58.3, 59.1, 81/177.4

(56) References Cited

U.S. PATENT DOCUMENTS

| | | | | |
|---|---|---|---|---|
| 4,341,292 | * | 7/1982 | Acevedo | 192/43 |
| 4,448,097 | * | 5/1984 | Rocca | 81/177.4 |
| 5,406,866 | * | 4/1995 | Badiali | 81/57.3 |
| 5,651,294 | * | 7/1997 | Shiao | 81/59.1 |
| 5,819,612 | * | 10/1998 | Anderson | 81/490 |
| 5,894,765 | * | 4/1999 | Anderson et al. | 81/60 |
| 5,904,080 | * | 5/1999 | Anderson et al. | 81/439 |
| 5,943,921 | * | 8/1999 | Lin | 81/59.1 |

* cited by examiner

*Primary Examiner*—David A. Scherbel
*Assistant Examiner*—David B. Thomas
(74) *Attorney, Agent, or Firm*—Jacobson, Price, Holman & Stern, PLLC

(57) ABSTRACT

A torsion screwdriver includes a positioning sleeve, a locking tube, a plurality of locking cylinder rods, a curved spring strip, a rotary member, a coupling sleeve, and a bit-driving shaft. The locking tube is disposed in the positioning sleeve, and is formed with rod-retaining slots for receiving the locking cylinder rods. The curved spring strip has one end connected to the locking tube, and the other end abutting against a projection at a front end of the positioning sleeve. The coupling sleeve is disposed in a sleeve-receiving hole of the locking tube, which is communicated with the rod-receiving slots, such that rotation of the positioning sleeve in a first direction results in co-rotation of the coupling sleeve with the positioning sleeve, whereas rotation of the positioning sleeve in a second direction results in idle rotation of the positioning sleeve relative to the coupling sleeve. The rotary member is coupled to the locking tube for co-rotation therewith, and the coupling sleeve is retained rotatably on the rotary member. The bit-driving shaft extends into the coupling sleeve, and is formed with keys for engaging keyways in the coupling sleeve to allow removable and non-rotatable coupling of the bit-driving shaft with the coupling sleeve.

9 Claims, 5 Drawing Sheets

TORSION SCREWDRIVER

BACKGROUND OF THE INVENTION

1. Field of the Invention

The invention relates to a screwdriver, more particularly to a multi-purpose screwdriver that is convenient to use.

2. Description of the Related Art

A conventional screwdriver generally has a handle. One end of the handle is provided with a tool bit for driving a screw. In use, as the space in which the screwdriver works is often small and narrow, the user does not have enough room to manipulate the screwdriver smoothly. This need resulted in the development of a torsion screwdriver that can be turned in a single direction. Referring to FIG. 1, a conventional torsion screwdriver 1 is shown to include a hollow handle 11, a positioning sleeve 12 provided in the handle 11, a locking tube 13 received in the positioning sleeve 12, a plurality of locking cylinder rods 14 provided between the positioning sleeve 12 and the locking tube 13, a curved spring strip 15 provided on the locking tube 13, a rotary member 16 connected to the locking tube 13, and a bit-driving shaft 17 that can pass through all of the rotary member 16, the locking tube 13, and the positioning sleeve 12. The handle 11 has a hollow interior defining a receiving space 111 with a substantially square-shaped cross-section. One end of the handle 11 is closed by a screw cap 113. A packing ring 112 is used to ensure the closure effect. The positioning sleeve 12 has a front end provided with an inward projection 122, and a rear end formed with a through hole 121 for extension of a first end of the bit-driving shaft 17. There is further provided a retaining ring 18 on an outer side of the through hole 121 to secure the bit-driving shaft 17 onto the positioning sleeve 12. Furthermore, the locking tube 13 is generally cylindrical, and has a front end provided with an annular outward flange 133. The above-mentioned curved spring strip 15 and the rotary member 16 are positioned on the annular outward flange 133 of the locking tube 13. The curved spring strip 15 has a first end passing through the annular outward flange 133 of the locking tube 13 to be retained by the inward projection 122 of the positioning sleeve 12. The locking tube 13 further has an axially extending positioning hole 131, and a plurality of axially extending rod-retaining slots 132 for receiving the locking cylinder rods 14. The rod-retaining slots 132 are communicated with the positioning hole 131. In addition, the bit-driving shaft 17 has a second end provided with a tool bit receiving hole adapted to receive a tool bit 171.

Reference is made to FIG. 2, which shows the screwdriver 1 in a state of use. With cross-reference to FIG. 1, when the handle 11 is turned in a certain direction, the positioning sleeve 12 forces the locking cylinder rods 14 to abut against a peripheral surface of the bit-driving shaft 17, thereby bringing the bit-driving shaft 17 to turn with the handle 11. When the handle 11 is turned in a reverse direction, the positioning sleeve 12 ceases to force the locking cylinder rods 14 against the peripheral surface of the bit-driving shaft 17 so that the bit-driving shaft 17 does not turn with the handle 11. The intended object of unidirectional rotation can therefore be achieved. However, since the bit-driving shaft 17 always has the peripheral surface thereof in contact with the locking cylinder rods 14 regardless of its turning direction, it cannot be independently detached from the screwdriver 1. This is because removal of the bit-driving shaft 17 from the locking tube 13 will cause the locking cylinder rods 14 to fall into the positioning hole 131 of the locking tube 13. If the user intends to change the tool bit 171 at the second end of the bit-driving shaft 17 with another one (not shown) pre-disposed in the receiving space 111 of the handle 11, the user has to remove the screw cap 113 and the packing ring 112 in order to have access to the tool bit in the receiving space 111. After installing the new tool bit, the user has to put the previous tool bit in the receiving space 111, and then put the packing ring 112 and the screw cap 113 back into position. It can be seen that the conventional screwdriver 1 is very troublesome and inconvenient to use. In addition, the tool bit receiving hole of the bit-driving shaft 17 is adapted for use with tool bits of a single size only, thereby limiting the utility of the conventional screwdriver 1.

SUMMARY OF THE INVENTION

Therefore, the main object of the present invention is to provide a torsion screwdriver that has multi-purposes and that is convenient to use.

Another object of the present invention is to provide a torsion screwdriver that allows easy replacement of tool bits.

Accordingly, a torsion screwdriver of the present invention comprises a positioning sleeve, a locking tube, a plurality of locking cylinder rods, a curved spring strip, a rotary member, a coupling sleeve, and a bit-driving shaft. The positioning sleeve is formed with an axially extending locking hole that is defined by a plurality of adjacent locking sides interconnected by adjoining corners. The positioning sleeve has a tubular part that is formed with the locking hole, a radial outward flange that is disposed on a front end of the tubular part, and an annular skirt that extends forwardly from an outer periphery of the radial outward flange. The annular skirt is formed with an inward projection. The locking tube is disposed in the positioning sleeve, and is formed with an axial sleeve-receiving hole and a plurality of axially extending rod-retaining slots communicated with the sleeve-receiving hole. The locking tube has a front end formed with an annular outward flange that is confined by the annular skirt. The locking cylinder rods are received in the rod-retaining slots, respectively. The curved spring strip has a first end connected to the annular outward flange of the locking tube, and a second end abutting against the inward projection on the annular skirt of the positioning sleeve. The rotary member is disposed adjacent to the front end of the locking tube, and is coupled to the annular outward flange of the locking tube for co-rotation therewith. The rotary member is formed with a through hole aligned with the sleeve-receiving hole of the locking tube. The coupling sleeve is disposed in the sleeve-receiving hole of the locking tube, and is in contact with the locking cylinder rods. Rotation of the positioning sleeve in a first direction results in engagement of the locking cylinder rods with the locking sides to permit co-rotation of the coupling sleeve with the positioning sleeve. Rotation of the positioning sleeve in a second direction results in alignment of the locking cylinder rods with the adjoining corners to disengage the locking cylinder rods from the locking sides and result in idle rotation of the positioning sleeve relative to the coupling sleeve. The coupling sleeve is formed with an axially extending coupling hole, and has a front end portion that extends into the through hole in the rotary member and that is retained rotatably on the rotary member. The bit-driving shaft extends into the coupling hole in the coupling sleeve. One of the bit-driving shaft and the coupling sleeve is formed with a radial key projection. The other one of the bit-driving shaft and the coupling sleeve is formed with an axially extending keyway that engages slidably the key projection to couple removably and non-rotatably the bit-driving shaft and the coupling sleeve.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
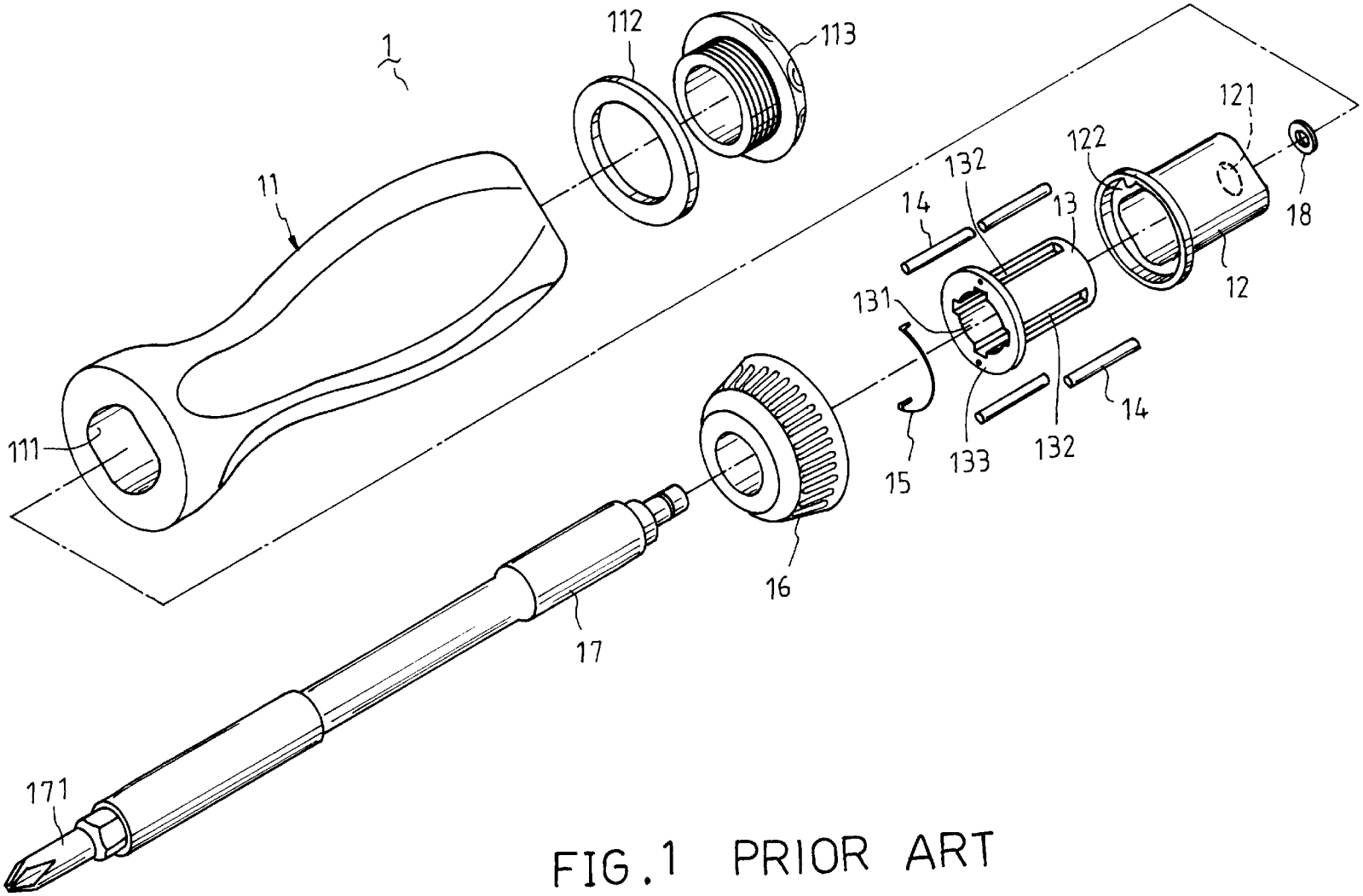
FIG. 1 PRIOR ART
FIG. 1 is an exploded perspective view of a torsion screwdriver of the prior art.
Figure 2:
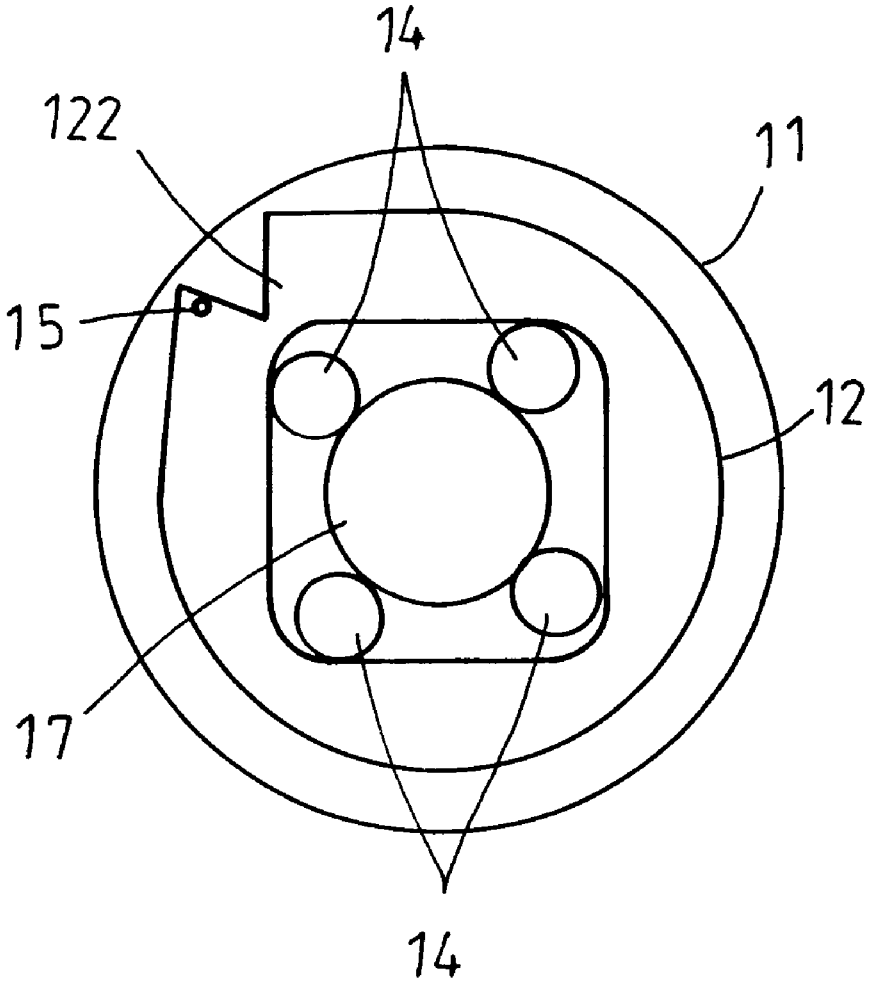
FIG. 2 PRIOR ART
FIG. 2 is a schematic view of the screwdriver of FIG. 1 in a state of use.
Figure 3:
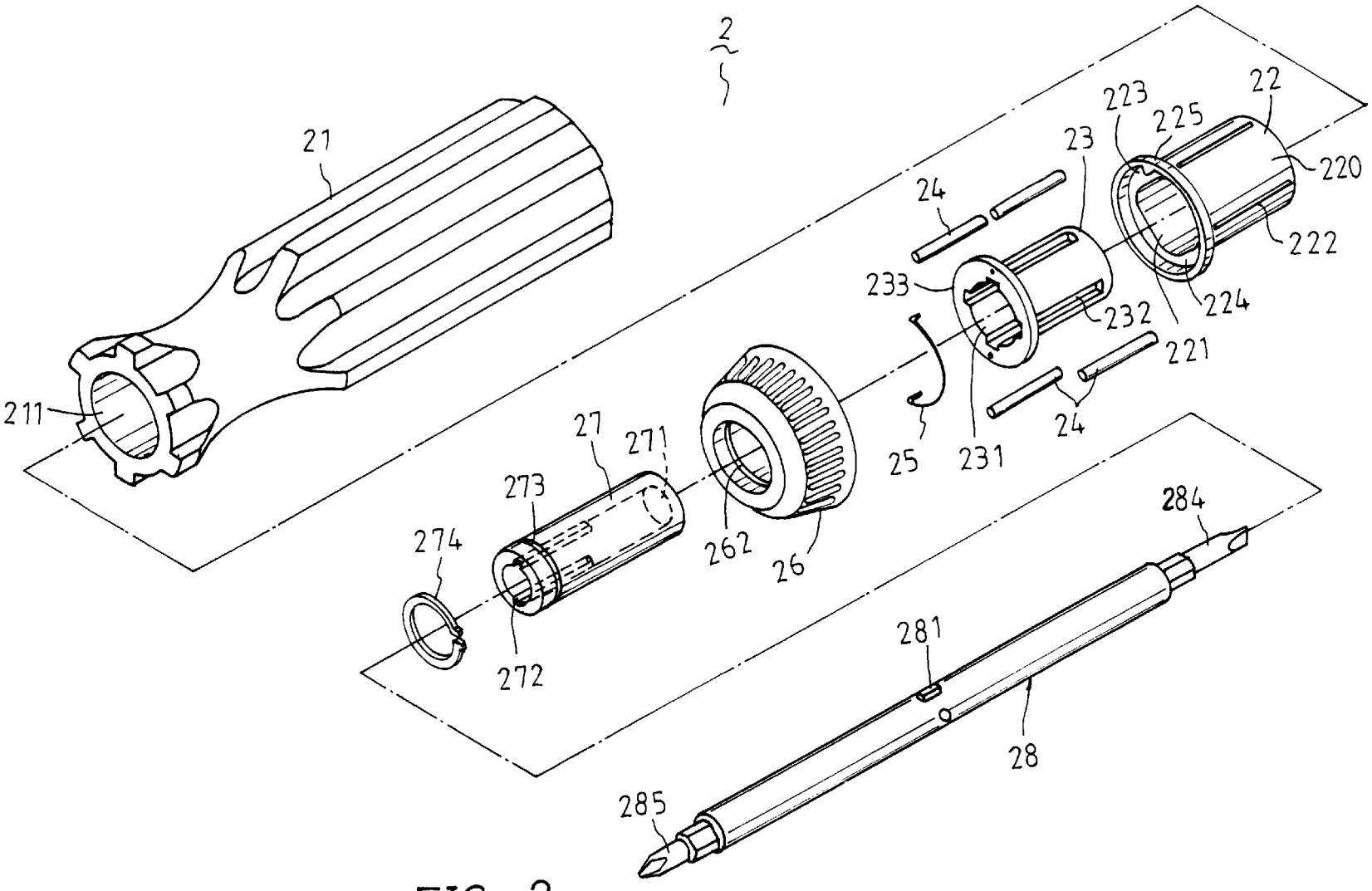
FIG. 3 is an exploded perspective view of a first preferred embodiment of a torsion screwdriver according to the present invention.

Referring to FIG. 3, the first preferred embodiment of a torsion screwdriver 2 according to the present invention is shown to include an elongate handle 21, a positioning sleeve 22, a locking tube 23, a plurality of locking rods 24, a curved spring strip 25, a rotary member 26, a coupling sleeve 27, and a bit-driving shaft 28.

The positioning sleeve 22 is formed with an axially extending locking hole 221 that is defined by a plurality of adjacent locking sides interconnected by adjoining corners. In this embodiment, the locking hole 221 is square-shaped. The positioning sleeve 22 has a tubular part 220 that is formed with the locking hole 221, a radial outward flange 224 that is disposed on a front end of the tubular part 220, and an annular skirt 225 that extends forwardly from an outer periphery of the radial outward flange 224. The annular skirt 225 is formed with an inward projection 223. The positioning sleeve 22 is further provided with a plurality of axially extending ribs 222 that project from an outer wall of the tubular part 220.

Figure 4:
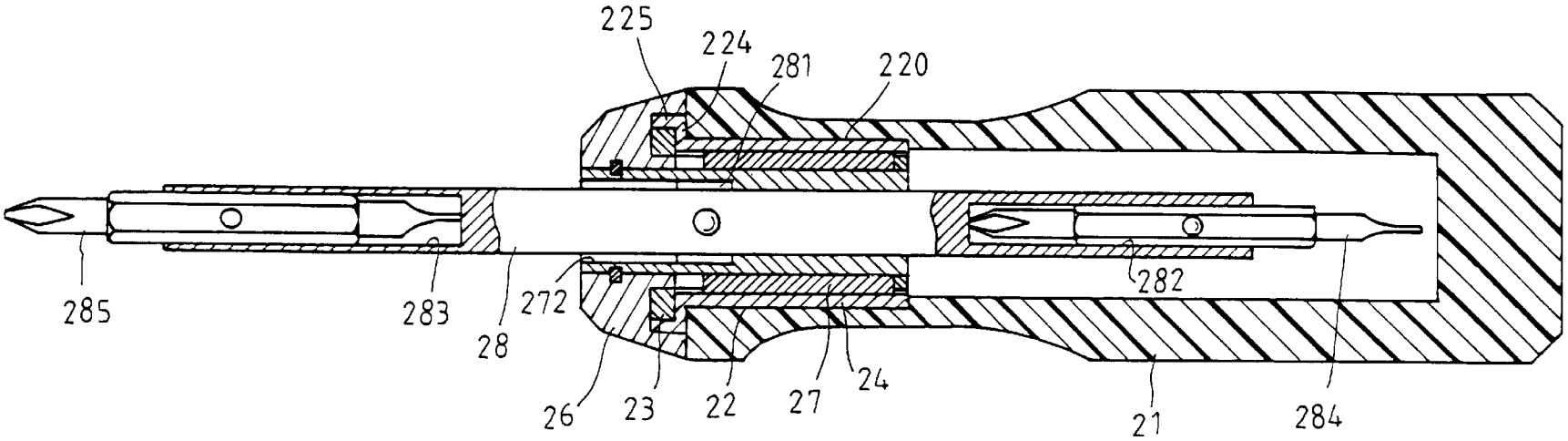
FIG. 4 is a cross-sectional view of the first preferred embodiment in a state of use.

The locking tube 23 is disposed in the positioning sleeve 22, and is formed with an axial sleeve-receiving hole 231 and a plurality of axially extending rod-retaining slots 232 communicated with the sleeve-receiving hole 231. The locking tube 23 has a front end formed with an annular outward flange 233 that is confined by the annular skirt 225 of the positioning sleeve 22 (see FIG. 4).

The locking cylinder rods 24 are received in the rod-retaining slots 232 of the locking tube 23, respectively.

The curved spring strip 25 has a first end connected to the annular outward flange 233 of the locking tube 23, and a second end abutting against the inward projection 223 on the annular skirt 225 of the positioning sleeve 22.

The rotary member 26 is disposed adjacent to the front end of the locking tube 23, and is coupled to the annular outward flange 233 of the locking tube 23 for co-rotation therewith. The rotary member 26 is formed with a through hole that is aligned with the sleeve-receiving hole 231 of the locking tube 23. The rotary member 26 is further formed with a first annular engaging groove 262 in the through hole thereof.

The coupling sleeve 27 is disposed in the sleeve-receiving hole 231 of the locking tube 23, and is in contact with the locking cylinder rods 24. Rotation of the positioning sleeve 22 in a first direction results in engagement of the locking cylinder rods 24 with the locking sides of the positioning sleeve 22 to permit co-rotation of the coupling sleeve 27 with the positioning sleeve 22, whereas rotation of the positioning sleeve 22 in a second direction results in alignment of the locking cylinder rods 24 with the adjoining corners of the positioning sleeve 22 to disengage the locking cylinder rods 24 from the locking sides to result in idle rotation of the positioning sleeve 22 relative to the coupling sleeve 27. The coupling sleeve 27 is formed with an axially extending coupling hole 271, and has a front end portion that extends into the through hole in the rotary member 26 and that is retained rotatably on the rotary member 26. The coupling sleeve 27 is further formed with a second annular engaging groove 273 that is registered with the first annular engaging groove 262 of the rotary member 26.

The bit-driving shaft 28 extends into the coupling hole 271 in the coupling sleeve 27. One of the bit-driving shaft 28 and the coupling sleeve 27 is formed with a radial key projection, while the other one of the bit-driving shaft 28 and the coupling sleeve 27 is formed with an axially extending keyway. The keyway engages slidably the key projection to couple removably and non-rotatably the bit-driving shaft 28 and the coupling sleeve 27. In the preferred embodiment, the bit-driving shaft 28 is formed with two radial key projections 281 (only one is shown), and the coupling sleeve 27 is formed with two keyways 272 for engaging slidably the key projections 281. The keyways 272 have a length that is shorter than that of the coupling sleeve 27. The bit-driving shaft 27 further has a first end portion, an intermediate portion, and a second end portion. The first end portion extends forwardly and outwardly of the coupling sleeve 27. The intermediate portion is disposed in the coupling hole 271 of the coupling sleeve 27. The second end portion extends rearwardly and outwardly of the coupling sleeve 27 and through the sleeve-receiving hole 231 of the locking tube 23 and the locking hole 221 of the positioning sleeve 22. Each of the first and second end portions of the bit-receiving shaft 28 is formed with an axially extending tool bit receiving hole 283, 282 adapted for engaging a tool bit 285, 284. The tool bit receiving holes 283, 282 in the first and second end portions of the bit-driving shaft 28 have different cross-sectional areas.

The screwdriver of this embodiment further includes a coupling ring 274 that extends into the first and second annular engaging grooves 262, 273 to couple rotatably the coupling sleeve 27 and the rotary member 26.

The elongate handle 21 is formed with an axial mounting hole 211. The positioning sleeve 22 can be mounted fittingly in a front portion of the elongate handle 21 in the mounting hole 211 such that the second end portion of the bit-driving shaft 28 is disposed in the mounting hole 211.

In the present embodiment, as the bit-driving shaft 28 extends through the rotary member 26 into the locking tube 23, the coupling sleeve 27 is in contact with the locking cylinder rods 24, and the bit-driving shaft 28 is removably and non-rotatably coupled with the coupling sleeve 27. When the elongate handle 21 is turned, the locking cylinder rods 24 will abut against the coupling sleeve 27, thereby bringing the coupling sleeve 27 to rotate therewith. The coupling sleeve 27 further brings the bit-driving shaft 28 to rotate therewith so that the tool bit 285 at the first end portion of the bit-driving shaft 27 can turn unidirectionally to drive a screw. Furthermore, due to the arrangement of the coupling sleeve 27 that abuts against the locking cylinder rods 24, and due to the provision of the key projections 281 and the keyways 272, even if the bit-driving shaft 28 is inserted into or removed from the coupling sleeve 27, the positioning of the locking cylinder rods 24 will not be affected. In other words, the bit-driving shaft 28 can be removed from the coupling sleeve 27 at any time to allow replacement of the tool bits 284 or 285. Besides, the tool bits 284, 285 in the present embodiment can be configured to have two different bit portions so that it is only necessary to turn the tool bit 284 or 285 around to use the different bit portion at the other end without the need for removing the bit-driving shaft 28 from the coupling sleeve 27. Furthermore, the cross-sectional areas of the first and second tool bit receiving holes 283, 282 are configured to have different diameters so that they are adapted to receive tool bits of different sizes.

Figure 5:
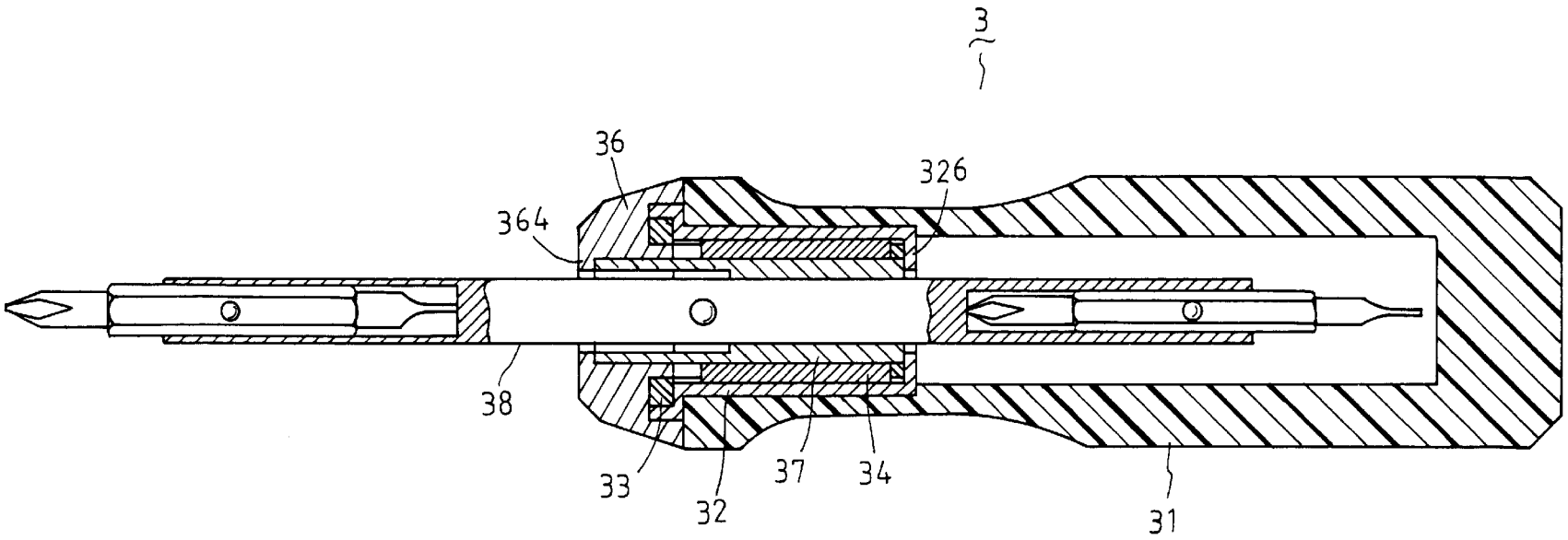
FIG. 5 is a cross-sectional view of a second preferred embodiment of a torsion screwdriver according to the present invention.

FIG. 5 illustrates the second preferred embodiment of a torsion screwdriver 3 according to the present invention. Like the first preferred embodiment described beforehand, the torsion screwdriver 3 includes an elongate handle 31, a positioning sleeve 32, a locking tube 33, a plurality of locking rods 34, a curved spring strip (not shown), a rotary member 36, a coupling sleeve 37, and a bit-driving shaft 38. Unlike the first preferred embodiment, the tubular part of the positioning sleeve 32 has a rear end formed with a first radial inward annular end flange 326. The rotary member 36 is formed with a second radial inward annular end flange 364 that extends into the through hole thereof. The coupling sleeve 37 is confined between the first and second radial inward annular end flanges 326, 364. Thus, the need for a coupling ring 274 (see FIG. 3) to couple rotatably the coupling sleeve 27 and the rotary member 26 as taught in the previous embodiment has been dispensed with, thereby obviating the need to form annular engaging grooves similar to those in the coupling sleeve 27 and the rotary member 26 of the previous embodiment to simplify the manufacturing process and reduce costs. The operation of the second preferred embodiment is similar to that of the previous embodiment and will not be described herein.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A torsion screwdriver comprising:

a positioning sleeve formed with an axially extending locking hole that is defined by a plurality of adjacent locking sides interconnected by adjoining corners, said positioning sleeve having a tubular part that is formed with said locking hole, a radial outward flange that is disposed on a front end of said tubular part, and an annular skirt that extends forwardly from an outer periphery of said radial outward flange, said annular skirt being formed with an inward projection;

a locking tube disposed in said positioning sleeve and formed with an axial sleeve-receiving hole and a plurality of axially extending rod-retaining slots communicated with said sleeve-receiving hole, said locking tube having a front end formed with an annular outward flange that is confined by said annular skirt;

a plurality of locking cylinder rods received in said rod-retaining slots, respectively;

a curved spring strip having a first end connected to said annular outward flange of said locking tube, and a second end abutting against said inward projection on said annular skirt of said positioning sleeve;

a rotary member disposed adjacent to said front end of said locking tube and coupled to said annular outward flange of said locking tube for co-rotation therewith, said rotary member being formed with a through hole aligned with said sleeve-receiving hole of said locking tube;

a coupling sleeve disposed in said sleeve-receiving hole of said locking tube and in contact with said locking cylinder rods, rotation of said positioning sleeve in a first direction resulting in engagement of said locking cylinder rods with said locking sides to permit co-rotation of said coupling sleeve with said positioning sleeve, rotation of said positioning sleeve in a second direction resulting in alignment of said locking cylinder rods with said adjoining corners to disengage said locking cylinder rods from said locking sides and result in idle rotation of said positioning sleeve relative to said coupling sleeve, said coupling sleeve being formed with an axially extending coupling hole, and having a front end portion that extends into said through hole in said rotary member and that is retained rotatably on said rotary member; and a bit-driving shaft extending into said coupling hole in said coupling sleeve, one of said bit-driving shaft and said coupling sleeve being formed with a radial key projection, the other one of said bit-driving shaft and said coupling sleeve being formed with an axially extending keyway that engages slidably said key projection to couple removably and non-rotatably said bit-driving shaft and said coupling sleeve.

2. The torsion screwdriver as claimed in claim 1, wherein said keyway is formed in said coupling sleeve and has a length that is shorter than that of said coupling sleeve.

3. The torsion screwdriver as claimed in claim 1, wherein said rotary member is formed with a first annular engaging groove in said through hole, said coupling sleeve being formed with a second annular engaging groove that is registered with said first annular engaging groove, the screwdriver further comprising a coupling ring that extends into said first and second annular engaging grooves to couple rotatably said coupling sleeve and said rotary member.

4. The torsion screwdriver as claimed in claim 1, wherein said locking hole is square-shaped.

5. The torsion screwdriver as claimed in claim 1, wherein said bit-driving shaft has a first end portion extending forwardly and outwardly of said coupling sleeve, an intermediate portion disposed in said coupling hole of said coupling sleeve, and a second end portion extending rearwardly and outwardly of said coupling sleeve and through said sleeve-receiving hole of said locking tube and said locking hole of said positioning sleeve.

6. The torsion screwdriver as claimed in claim 5, wherein each of said first and second end portions of said bit-driving shaft is formed with an axially extending tool bit receiving hole adapted for engaging a tool bit.

7. The torsion screwdriver as claimed in claim 6, wherein said tool bit receiving holes in said first and second end portions of said bit-driving shaft have different cross-sectional areas.

8. The torsion screwdriver as claimed in claim 5, further comprising an elongate handle formed with an axial mounting hole, said positioning sleeve being mounted fittingly in a front portion of said elongate handle in said mounting hole such that said second end portion of said bit-driving shaft is disposed in said mounting hole.

9. The torsion screwdriver as claimed in claim 1, wherein said tubular part of said positioning sleeve has a rear end formed with a first radial inward annular end flange, said rotary member being formed with a second radial inward annular end flange that extends into said through hole thereof, said coupling sleeve being confined between said first and second radial inward annular end flanges.

* * * * *